US008602077B2

(12) United States Patent
Bixen et al.

(10) Patent No.: US 8,602,077 B2
(45) Date of Patent: Dec. 10, 2013

(54) ELECTRIC TAMP-BLOW LABEL APPLICATOR

(75) Inventors: Robert W. Bixen, Dorsey, IL (US); Steven M. Dods, Marine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 63 days.

(21) Appl. No.: 13/355,330

(22) Filed: Jan. 20, 2012

(65) Prior Publication Data

US 2012/0205050 A1 Aug. 16, 2012

Related U.S. Application Data

(60) Provisional application No. 61/442,511, filed on Feb. 14, 2011.

(51) Int. Cl.

| | |
|---|---|
| ***B29C 65/60*** | (2006.01) |
| ***B32B 37/10*** | (2006.01) |
| ***B32B 39/00*** | (2006.01) |
| ***B32B 41/00*** | (2006.01) |
| ***B65C 9/14*** | (2006.01) |
| ***B65C 9/28*** | (2006.01) |

(52) U.S. Cl.

USPC ..... 156/358; 156/364; 156/384; 156/387; 156/537; 156/580; 156/767; 156/DIG. 2; 156/DIG. 4; 156/DIG. 38; 156/DIG. 42

(58) Field of Classification Search

USPC ..... 156/358, 363, 364, 384, 387, 537, 580, 156/750, 767, DIG. 1, DIG. 2, DIG. 4, 156/DIG. 24, DIG. 33, DIG. 37, DIG. 38, 156/DIG. 42

See application file for complete search history.

(56) References Cited

U.S. PATENT DOCUMENTS

| | | | | |
|---|---|---|---|---|
| 3,483,059 | A | 12/1969 | Dinter | |
| 5,853,530 | A | 12/1998 | Allen | |
| 5,885,406 | A | 3/1999 | Tiefel | |
| 6,451,149 | B1 * | 9/2002 | McKenney et al. | 156/238 |
| 6,807,998 | B2 | 10/2004 | Dods | |
| 6,817,397 | B2 | 11/2004 | Bixen | |
| 6,823,916 | B2 | 11/2004 | Dods | |
| 6,823,917 | B2 | 11/2004 | Dods | |
| 6,845,800 | B2 | 1/2005 | Dods et al. | |
| 7,193,517 | B2 | 3/2007 | Dods | |
| 2005/0167024 | A1 | 8/2005 | Sanzone | |

FOREIGN PATENT DOCUMENTS

| | | |
|---|---|---|
| EP | 1219541 | 7/2002 |

OTHER PUBLICATIONS

International Search Report for PCT/US2012/024878, dated Sep. 20, 2012.

* cited by examiner

*Primary Examiner* — Sing P Chan
(74) *Attorney, Agent, or Firm* — Levenfeld Pearlstein, LLC

(57) ABSTRACT

A tamp pad includes a housing that defines an air flow chamber having an inflow opening and an outflow opening. The tamp pad further includes an impact plate having one or more openings therethrough that are in fluid communication with the air flow chamber and an air flow generator fluidly coupled to the air flow chamber for generating an air flow in a first direction. The tamp pad has a valve system for directing the air flow generated by the air flow generator to draw air into the one or more openings to hold a label thereon and to blow air out of the one or more openings to eject the label from the impact plate.

15 Claims, 5 Drawing Sheets

ELECTRIC TAMP-BLOW LABEL APPLICATOR

CROSS-REFERENCE TO RELATED APPLICATION DATA

This application claims the benefit of priority of Provisional U.S. Patent Application Ser. No. 61/442,511, filed Feb. 14, 2011, the disclosure of which is incorporated herein by reference in its entirety.

BACKGROUND

The present disclosure is directed to a label applicator and, more particularly, to a tamp-blow label applicator that is configured to receive labels fed from a web and apply such labels to one or more objects.

Automated printed label applicator machines or systems are well known in the art. In one example, such a machine utilizes a continuous web of label material that includes a carrier or liner and a series of discrete labels adhered to the liner at intervals therealong. The machine removes the labels from the liner and applies the labels to objects. In some such machines, the label is also printed by the machine prior to separation from the liner and application to the objects.

Known label machines generally include a supply roll on which the web is wound. The web is fed from the supply roll around a plurality of rollers past a printing head or imaging device. The printing head prints indicia and/or information, such as logos, bar codes, serial numbers, tracking information, etc., onto the individual labels and the web exits the print head as the labels are separated from the liner and positioned for contact with a tamp pad.

A typical tamp pad holds individual labels and moves the labels into contact with the objects onto which they will be adhered. Generally, the tamp pad may be a vacuum assisted assembly configured such that a label is transferred onto the pad after it is separated from the liner with the non-adhesive side of the label contacting an impact plate on a front side of the tamp pad. Typical impact plates are formed from a low friction material having a plurality of vacuum openings formed therethrough. Vacuum channels are formed in a rear of the plate. The plate is mounted to a mounting plate at a rear of the tamp pad through which a vacuum port provides communication from a vacuum source to the rear of the impact plate. A vacuum is drawn through the vacuum openings to secure the non-adhesive side of the label to the impact plate after separation from the liner and prior to application to the object surface.

The label remains on the pad until the target object is in line with the pad. A tamp actuator then extends to move the tamp pad into contact with the object surface to apply the label to the surface. At the completion of the extension stroke, the actuator returns the pad to a home or starting position at which time a subsequent label can be fed onto the tamp pad. After separating the labels from the liner, the liner can be accumulated onto a rewind or take-up roll for subsequent disposal.

To further facilitate the application of the label to the object surface, some tamp pads are coupled with an air flow source to blow air through the vacuum openings to blow or eject the label onto the surface. In such tamp pads or tamp-blow label applicators, the air flow source to blow air through the vacuum openings may include a compressed air source and the vacuum source may include a motor driven fan. However, such prior tamp pads require a compressed air source, which may be unavailable or inconvenient in some situations. Further, the use of a separate air flow source to blow air through the vacuum openings and a vacuum source to draw air through the openings requires specialized switching, timing, and/or control components to operate the tamp pad effectively.

Accordingly, there is a need and desire for a tamp-blow label applicator that can be utilized to secure or hold a label and to blow the label onto a surface without the need for separate air and vacuum supply source and specialized components to control the multiple air flow sources.

BRIEF SUMMARY

According to one example, a tamp pad includes a housing that defines an air flow chamber having an inflow opening and an outflow opening. The tamp pad further includes an impact plate having one or more openings therethrough that are in fluid communication with the air flow chamber and an air flow generator fluidly coupled to the air flow chamber for generating an air flow in a first direction. In addition, the tamp pad has a valve system disposed within the air flow chamber for directing the air flow generated by the air flow generator to draw air into the one or more openings to hold a label thereon and to blow air out of the one or more openings to eject the label from the impact plate.

In another example, a label applicator system includes a moveable tamp pad actuator and a tamp pad mounted to the actuator. The tamp pad has a housing that defines an air flow chamber having an inflow opening and an outflow opening, an impact plate having one or more openings therethrough that are in fluid communication with the air flow chamber, and an air flow generator fluidly coupled to the air flow chamber for generating an air flow in a first direction. The tamp pad further includes a valve system disposed within the air flow chamber for directing the air flow generated by the air flow generator to draw air into the one or more openings to hold a label thereon and to blow air out of the one or more openings to eject the label from the impact plate.

Other objects, features, and advantages of the disclosure will be apparent from the following description, taken in conjunction with the accompanying sheets of drawings, wherein like numerals refer to like parts, elements, components, steps, and processes.

BRIEF DESCRIPTION OF THE DRAWINGS

Details of the present disclosure, including non-limiting benefits and advantages, will become more readily apparent to those of ordinary skill in the relevant art after reviewing the following detailed description and accompanying drawings, wherein.

DETAILED DESCRIPTION

Figure 1:
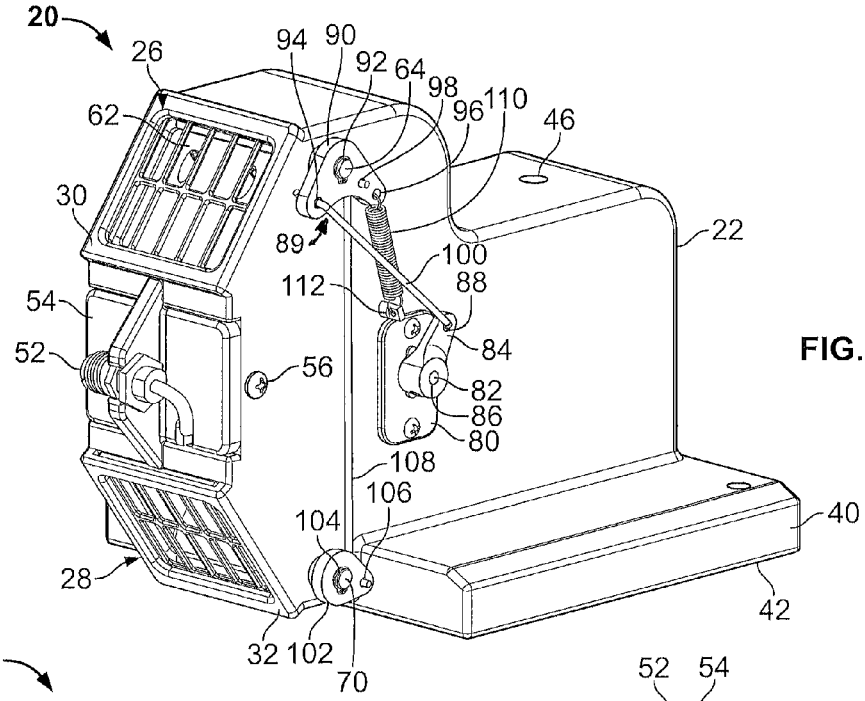
FIG. 1 is a perspective view of a tamp-blow label applicator in accordance with an embodiment of the present disclosure.
Figure 2:
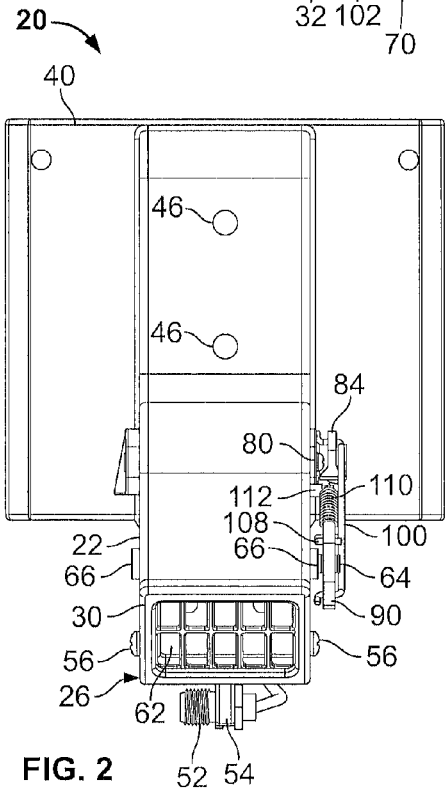
FIG. 2 is a top view of the label applicator of FIG. 1.
Figure 3:
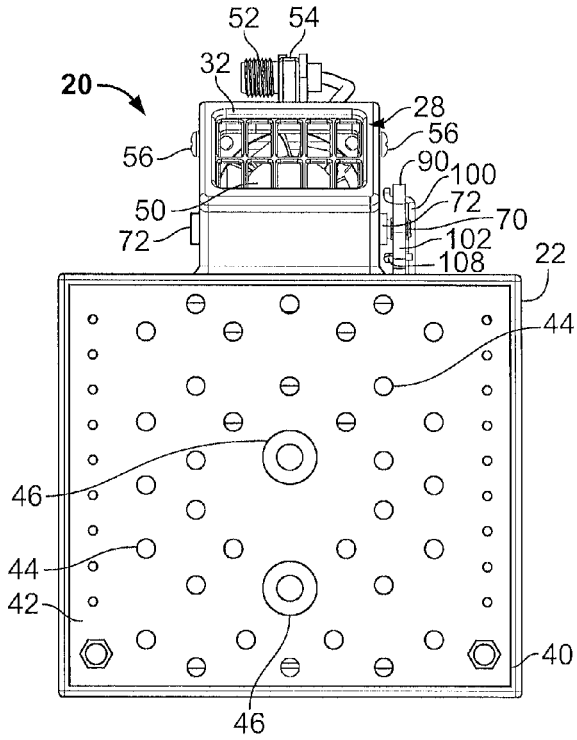
FIG. 3 is a bottom view of the label applicator of FIG. 1.
Figure 4:
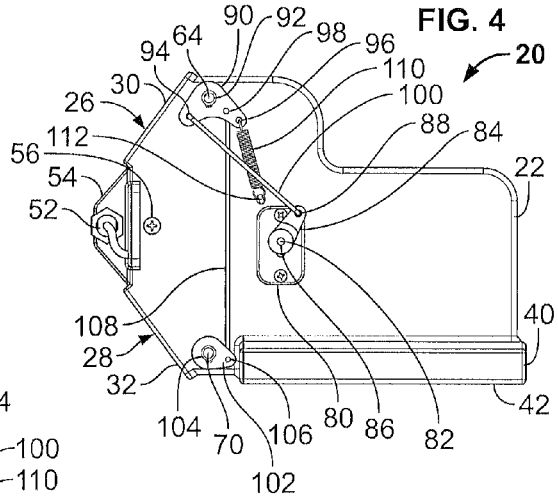
FIG. 4 is a right side elevational view of the label applicator of FIG. 1.
Figure 5:
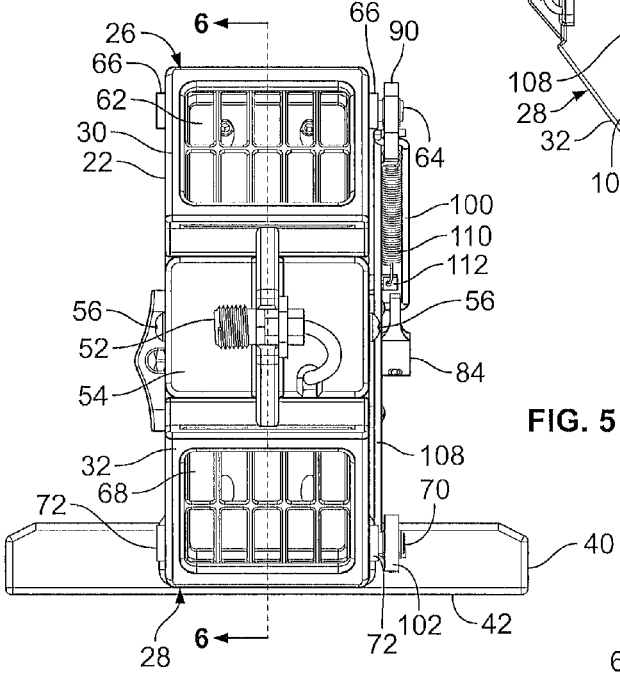
FIG. 5 is a front view of the label applicator of FIG. 1.
Figure 6:
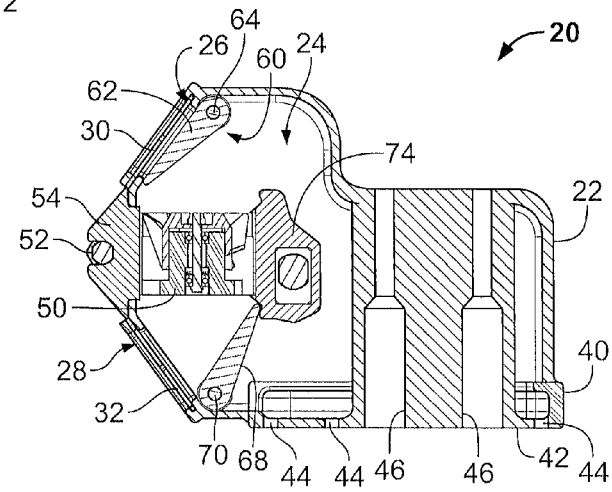
FIG. 6 is a cross-sectional view of the label applicator of FIG. 1 taken generally along lines 6-6 in FIG. 5.
Figure 7:
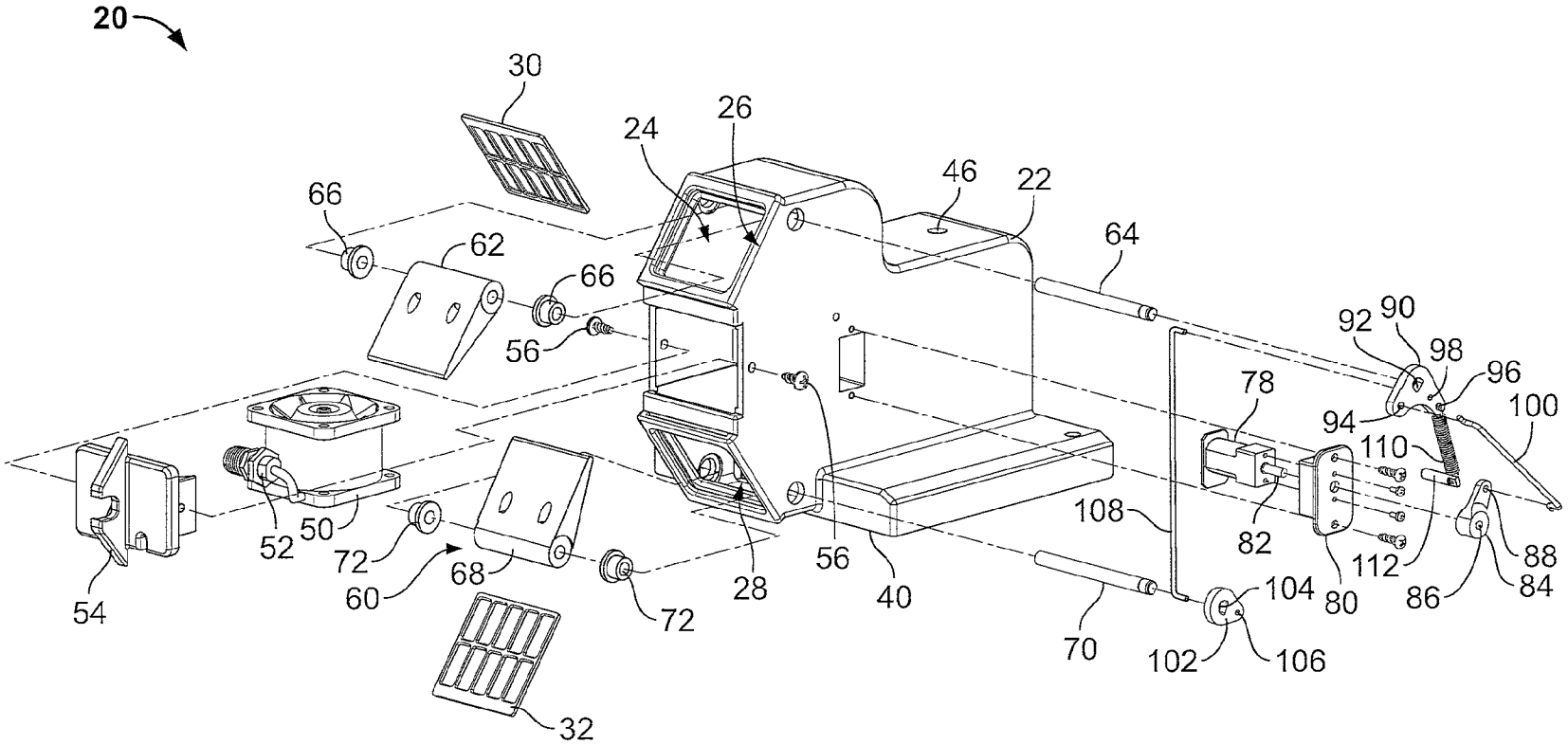
FIG. 7 is an exploded view of the label applicator of FIG. 1.

While the present disclosure is susceptible of embodiment in various forms, there is shown in the drawings and will hereinafter be described an embodiment with the understanding that the present disclosure is to be considered an example and is not intended to limit the disclosure to the specific embodiment illustrated.

Referring now to FIGS. 1-9, a tamp-blow label applicator 20 includes a housing 22 with an air flow chamber 24 defined therein. The housing 22 further includes first and second openings 26, 28, respectively, in fluid communication with the air flow chamber 24. First and second covers 30, 32, respectively, may be disposed over the first and second openings 26, 28, respectively. In one example, the first opening 26 may be considered an inflow opening or vent and the second opening 28 may be considered an outflow opening or vent, as will be described in more detail hereinafter. Further, in the present example the first opening 26 is disposed above the second opening 28 and is generally axially aligned therewith, such as along the substantially vertical axis line 6-6. However, other arrangements and configurations of the first and second openings 26, 28 are also contemplated and considered within the scope of the present disclosure.

The label applicator 20 also includes an impact plate 40 disposed at a lower portion thereof. The impact plate 40 may be formed from a low friction material, such as a low friction plastic or metal material, and has a substantially planar face 42 including a plurality of vacuum openings or through holes 44. The openings 44 are further in fluid communication with the air flow chamber 24. One or more openings 46 through the housing 22 and the impact plate 40 allow the label applicator 20 to be mounted to a tamp actuator of a label machine, such as by known fasteners or screws. In the present example, the openings 46 are counter-bored so that a fastener or screw inserted therein will sit flush with or be disposed inwardly from the planar surface 42 of the impact plate 40. Alternatively or in conjunction, the label applicator 20 may include other known features to mount the label applicator to a label machine in a removable or fixed manner without departing from the spirit and scope of the present invention.

An air flow generator 50 is further in fluid communication with the air flow chamber 24. In the present example, the air flow generator 50 is disposed within the air flow chamber 24. However, in other examples, the air flow generator 50 may be disposed externally from the air flow chamber 24 and fluidly coupled thereto by vents, ducts, and/or in any other known manner. The air flow generator 50 can be an electrically powered fan, such as an axial fan, a centrifugal or squirrel cage-type fan, a crossflow fan, a bladeless-type fan, etc. The air flow generator 50 illustrated in the present FIGS. includes an electrical coupling 52 to receive power from a power supply, as would be apparent to one of ordinary skill.

A retainer 54 is coupled to the housing 22 by screws 56 or in any other known manner and is configured to retain or secure the air flow generator 50 to the housing. In the present example, the retainer 54 retains a portion of the electrical coupling 52 to secure the air flow generator 50 within the air flow chamber 24 between the first and second openings 26, 28 and axially aligned with the first and second openings, such as along the substantially axis line 6-6. This arrangement creates an efficient and effective air flow within the chamber 24 for both the vacuum and blow functions, as will be described in more detail hereinafter. However, in other embodiments, the air flow generator 50 and the first and second openings 26, 28 may be arranged differently without departing from the spirit and scope of the present disclosure.

In accordance with the present example, the label applicator 20 includes a valve system 60 disposed within the air flow chamber 24. The valve system 60 is configured to direct the flow of air produced by the air flow generator 50 to draw air into the one or more openings 44 of the impact plate 40 to hold a label thereon and to redirect air to blow air out of the one or more openings to eject and apply the label onto a surface. More particularly, the valve system 60 includes a first baffle 62 movably coupled to the housing 22 adjacent the first opening 26 in any known manner, such as by a first shaft 64 and bearings 66. The valve system 60 further includes a second baffle 68 movably coupled to the housing 22 adjacent the second opening 28 similarly to the first baffle 62, such as by a second shaft 70 and bearings 72, or in any other known manner. The first and second baffles 62, 68 are generally fixedly coupled to the first and second shafts 64, 70, respectively, to pivot with the shafts when the shafts are rotated.

Figure 8:
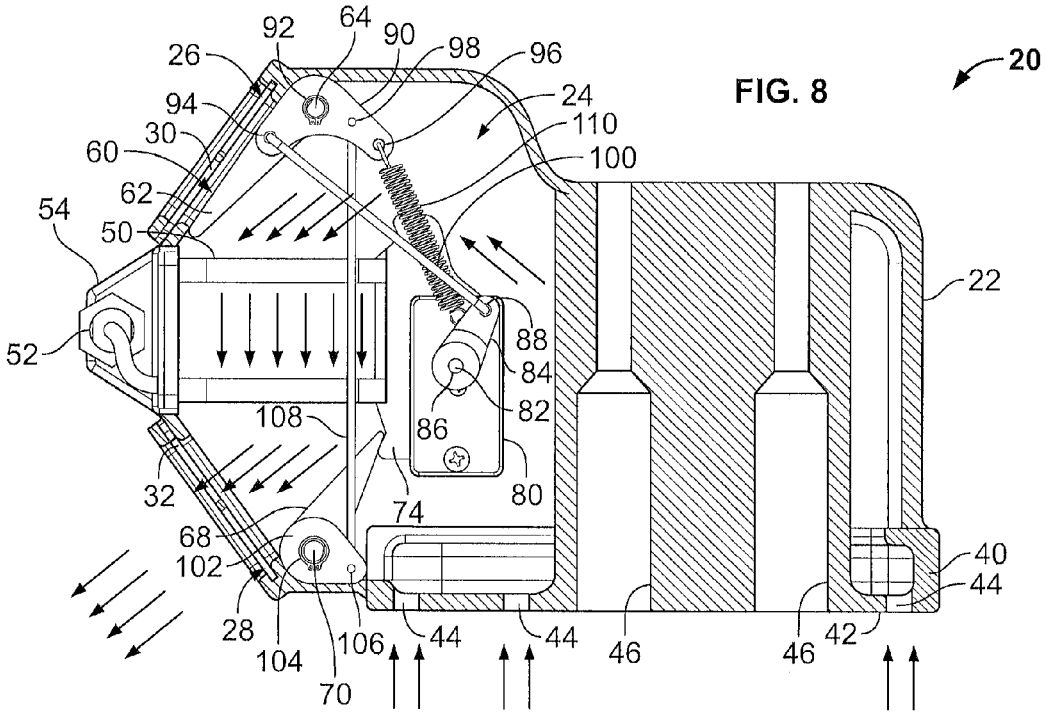
FIG. 8 is a partial cross-sectional view of the label applicator of FIG. 1, similar to FIG. 6, showing a flow of air being drawn into tamp pad openings of the label applicator.
Figure 9:
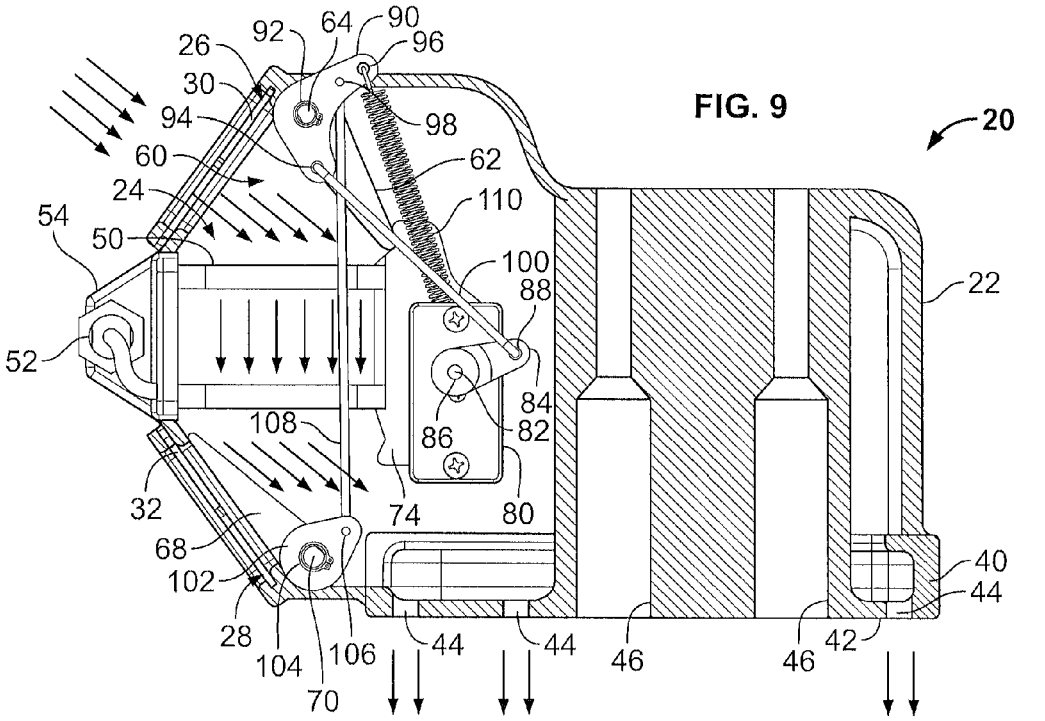
FIG. 9 is a partial cross-sectional view of the label applicator of FIG. 1, similar to FIG. 6, showing a flow of air being blown out of tamp pad openings of the label applicator.

Further, the valve system 60 is generally moveable between a first state (shown generally in FIGS. 6 and 8) and a second state (shown generally in FIG. 9). In the first state, the first baffle 62 is in a first position where the first opening 26 is obstructed and the second baffle 68 is in a first position where the second opening is unobstructed. Further, in the first state, the second baffle 68 is disposed against a lower portion of a central member 74 within the housing 22 to provide a single air flow path from the opening(s) 44 in the impact plate 40, up around the central member, and down and out through the second opening 28, as is shown by the arrows indicating air flow in FIG. 8. In the second state of the valve system 60, the second baffle 68 is in a second position where the second opening 28 is obstructed and the first baffle 62 is in a second position where the first opening 26 is unobstructed. Further, in the second state, the first baffle 62 is disposed against an upper portion of the central member 74 to provide a single air flow path in through the first opening 26, down past the central member, and out through the opening(s) 44 in the impact plate 40, as is shown by the arrows indicating air flow in FIG. 9.

An actuating element 78 is coupled to the housing 22 by a mount 80 or by any other known means. In one example, the actuating element 78 can be a motor having a drive shaft 82 that is coupled to the valve system 60 to move the first and second baffles 62, 68 between the first and second states. The drive shaft 82 of the actuating element 78 is coupled to a motor arm 84, which has a first opening 86 disposed proximate a first end thereof and a second opening 88 disposed proximate a second opposing end thereof. In the present example, the drive shaft 82 of the actuating element 78 is coupled to the first opening 86 of the motor arm 84.

A linkage 89 includes a first arm 90 coupled to the first baffle 62, for example, with an end of the first shaft 64 disposed in a first opening 92 in the first arm. The first opening 92 in the first arm 90 is generally centrally disposed on the first arm and the connection to the end of the first shaft 64 causes the first arm to function generally as a curved lever arm, as will be described in more detail hereinafter. The first arm 90 further includes a second opening 94 disposed proximate a first end of the arm, a third opening 96 disposed at a second opposing end of the arm, and a fourth opening 98 disposed generally between the first and third openings 92, 96. A drive or drag link 100 couples the first arm 90 to the motor arm 84. In the present example, a first end of the drag link 100 is coupled to the second opening 94 in the first arm 90 and a second end of the drag link is coupled to the second opening 88 in the motor arm 84.

The linkage 89 further includes a second arm 102 coupled to the second baffle 68. The second arm 102 includes a first opening 104 disposed proximate a first end thereof and a second opening 106 disposed proximate a second end thereof. In the present example, the second shaft 70 is disposed in the first opening 104 of the second arm 102 to couple the second arm to the second baffle 68. A tie link or rod 108 couples the first and second arms 90, 102 together. More particularly, in the present example, a first end of the tie rod 108 is coupled to the fourth opening 98 in the first arm 90 and a second end of the tie rod is coupled to the second opening 106 of the second arm 102. Further, a biasing element 110, such as an extension spring, is coupled at a first end thereof to the third opening 96 of the first arm 90 and at a second end thereof to an anchor 112 mounted on the housing 22.

Referring now to FIG. 8, which illustrates the tamp-blow label applicator 20 in the first state, and FIG. 9, which illustrates the label applicator in the second state, the interaction between the valve system 60 and the actuating element 78 is shown in more detail with an air flow produced by the generator 50 illustrated generally by a plurality of arrows. More particularly, FIG. 8 illustrates the valve system 60 as it is normally held in the first state by the biasing member 110 urging the second end of the first arm 90 downwardly due to the coupling of the biasing member between the third opening 96 of the first arm and the anchor 112. Such arrangement of the first arm 90 corresponds to the first baffle 62 being disposed against the first opening 26 to obstruct same. With the second end of the first arm 90 urged downwardly, the second end of the second arm 102 is likewise urged downwardly due to the connection of the tie rod 108 between the fourth opening 98 in the first arm and the second opening 106 in the second arm. With the second end of the second arm 102 urged downwardly, the second baffle 68 is pivoted away from the second opening 28 to unobstruct same and the second baffle is further held against the lower portion of the central member 74.

In use, the air flow generator 50 can be controlled to turn on or off, or kept on at all times during operation, to produce an air flow in a single direction and the valve system 60 can be actuated between the first and second states to alternatingly and selectively draw a vacuum through the impact plate openings 44 or blow air through such openings. In the present example, the air flow generator 50 produces an air flow in a generally downward direction, as illustrated in FIGS. 8 and 9. Referring more particularly to FIG. 8, when the valve system 60 is in the first state, the generator 50 produces an air flow in the chamber 24 such that air is blown through the second or outflow opening 28, thus, causing air to be drawn into the openings 44 in the impact plate 40 and creating a vacuum that will hold a label thereto.

Referring to FIG. 9, when the label is ready to be blown or ejected from the impact plate 40 and applied to a substrate, the actuating element 78 is actuated to move the valve system 60 to its second state. More particularly, the drive shaft 82 of the actuating element 78 is actuated to rotate in a clockwise direction, which rotates the first end of the first arm 90 in a generally downward and counterclockwise direction by means of the drag link 100 connection between the second opening 88 in the motor arm 84 and the second opening 94 in the first arm. The counterclockwise rotation of the first arm 90 causes the first baffle 62 to rotate away from the first opening 26 thus unobstructing same and to be held against the upper portion of the central member 74. Further, the generally downward movement of the first end of the first arm 90 causes the second end of the first arm to move generally upwardly due to the pivot point at the first opening 92. Such generally upward movement of the second end of the first arm 90 causes the second end of the second arm 102 to rotate generally upwardly in a counterclockwise direction due to the tie rod 108 connection between the fourth opening 98 in the first arm 90 and the second opening 106 in the second arm 102. Further, the upward movement of the second end of the first arm 90 also loads the biasing element 110 from its normal position. Such rotation of the second arm 102 causes the second shaft 70 to rotate in a counterclockwise direction and the second baffle 68 to rotate and obstruct the second opening 28.

In the second state, when the air flow generator 50 produces the air flow in the generally downward direction, air is drawn into the chamber 24 through the first or inflow opening 26 and blown out of the openings 44 in the impact plate 40 to blow the label therefrom. Thereafter, the actuating element 78 can be de-energized or actuated in a counterclockwise direction and the biasing element 110 will assist the valve system 60 to return to its first state in preparation of receiving another label.

Figure 10:
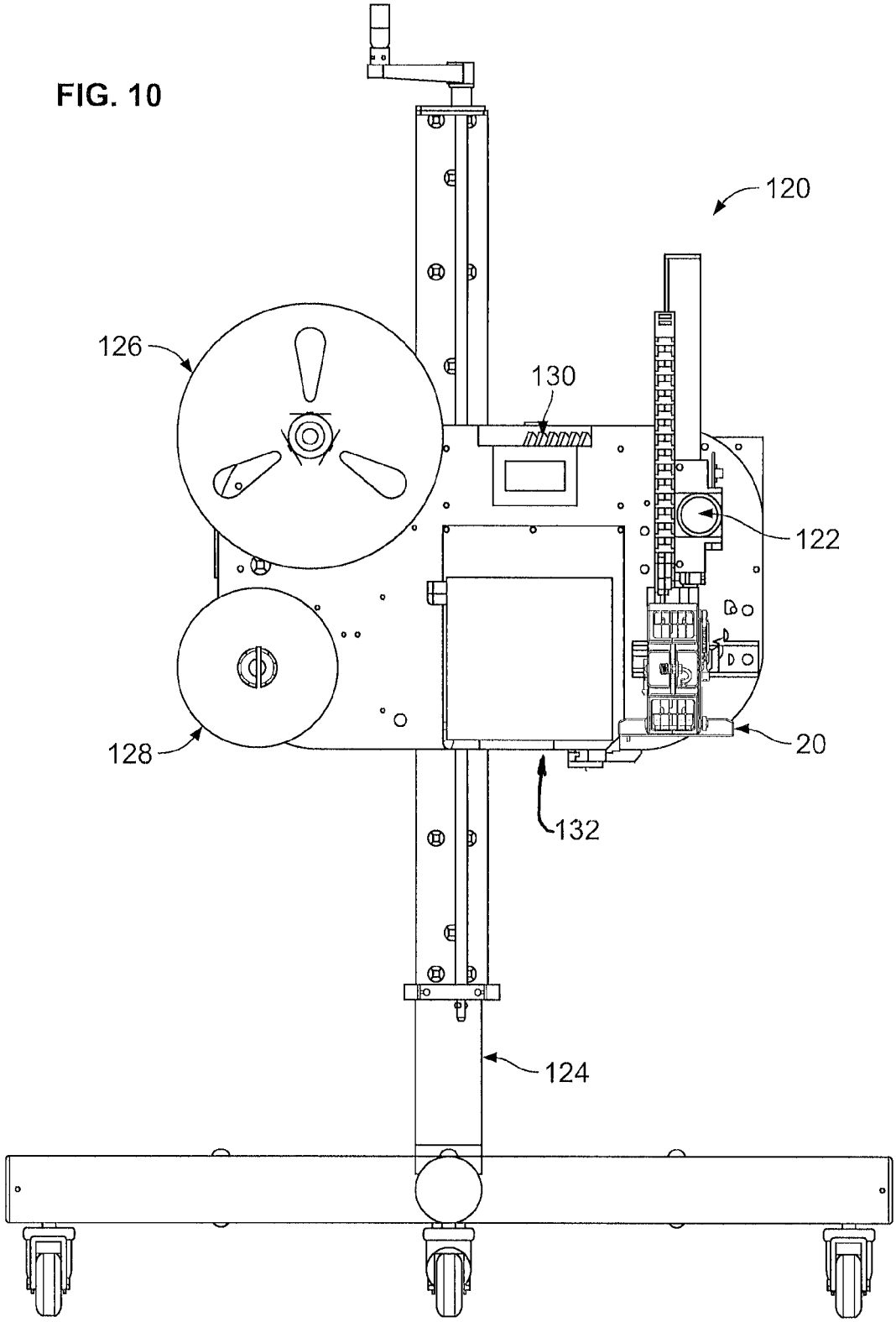
FIG. 10 is a front elevational view of a label applicator machine or system in accordance with an embodiment of the present disclosure configured with the tamp-blow label applicator of FIG. 1.

FIG. 10 illustrates a label applicator system 120 with the tamp-blow label applicator 20 mounted on a tamp actuator 122 thereof. The tamp actuator 122 can be a pneumatic cylinder, an electric actuator, or any other known type of actuator for moving the tamp pad into contact with an object surface. Generally, the label applicator system 120 is mounted on a frame or stand 124 and includes a supply roll 126, a rewind roll 128, a controller and/or user interface 130, and a printing unit 132, the functions of which are described above or would otherwise be apparent to those of ordinary skill in the art. Further details of such a label applicator system are disclosed in Dods U.S. Pat. No. 7,193,517 and Dods et al. U.S. Pat. No. 6,845,800, each of which is commonly assigned with the present application and is incorporated by reference herein in its entirety.

It will be appreciated by those skilled in the art that while certain functional aspects of the tamp-blow applicator are described using directional terms, for example, upwardly, downwardly, inwardly, and outwardly, such terms are generally used for non-limiting reference purposes only and numerous features of the present disclosure can be modified to function in different ways, wherein such modifications are considered within the scope and spirit of the present disclosure.

The present tamp-blow label applicator is configured to perform a vacuum function to hold a label to the label applicator and a blow function to eject or blow the label onto an object. In one aspect of the present label applicator, a single air flow generator can be used in conjunction with a valve system to perform both vacuum and blow functions. The single air flow generator can be an electric fan, thereby, obviating the need for a compressed air supply to be coupled to the label applicator. Further, the tamp-blow label applicator can be mounted on any suitable label applicator system to receive printed labels and apply such labels to objects. Such a label applicator system is more portable than known systems that need to be tethered by a hose to a compressed air supply.

In the present disclosure, the words "a" or "an" are to be taken to include both the singular and the plural. Conversely, any reference to plural items shall, where appropriate, include the singular. All patents referred to herein, are hereby incorporated herein by reference, whether or not specifically done so within the text of this disclosure.

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. A tamp pad, comprising:

a housing that defines an air flow chamber having an inflow opening and an outflow opening, the inflow opening disposed above the outflow opening;

an impact plate having one or more openings therethrough, the openings being in flow communication with the air flow chamber;

an air flow generator fluidly coupled to the air flow chamber for generating an air flow in a first direction, the air flow generator disposed between the inflow opening and the outflow opening such that the inflow opening, outflow opening and air flow generator are substantially aligned along an axis; and a valve system disposed within the air flow chamber for directing the air flow generated by the air flow generator to draw air into the one or more openings to hold a label thereon and to blow air out of the one or more openings to eject the label from the impact plate.

2. The tamp pad of claim 1, wherein the air flow generator is an electrically powered fan.

3. The tamp pad of claim 1, wherein the valve system includes a first baffle movably coupled to obstruct the inflow opening in a first state and unobstruct the inflow opening in a second state, and a second baffle movably coupled to obstruct the outflow opening in the second state and unobstruct the outflow opening in the first state, and wherein in the first state the air flow is directed to draw air into the one or more openings in the impact plate and in the second state the air flow is directed to blow air out of the one or more openings of the impact plate.

4. The tamp pad of claim 3 further including a linkage operably connecting the first baffle and the second baffle.

5. The tamp pad of claim 4, wherein the linkage includes an actuating element coupled to a first arm, a second arm coupled to the first baffle and actuated to move the first baffle between the first and second positions, a third arm coupled to the second baffle and actuated to move the second baffle between the first and second positions, wherein the first arm is coupled to the second arm by a drive link and the second arm is coupled to the housing by a biasing element, and wherein the second and third arms are coupled together by a tie link.

6. The tamp pad of claim 1, further including a structure for coupling the tamp pad to a label applicator machine.

7. The tamp pad of claim 6, wherein the structure includes one or more counter-bored holes defined through the housing for one or more fasteners to secure the tamp pad to a moveable tamp pad actuator of the label applicator.

8. A label applicator system, comprising:

a moveable tamp pad actuator; and tamp pad mounted to the actuator, wherein the tamp pad includes:

a housing that defines an air flow chamber having an inflow opening and an outflow opening, the inflow opening disposed above the outflow opening;

an impact plate having one or more openings therethrough that are in fluid communication with the air flow chamber;

an air flow generator fluidly coupled to the air flow chamber for generating an air flow in a first direction, the air flow generator disposed between the inflow opening and the outflow opening such that the inflow opening, outflow opening and air flow generator are substantially aligned along an axis; and a valve system disposed within the air flow chamber for directing the air flow generated by the air flow generator to draw air into the one or more openings to hold a label thereon and to blow air out of the one or more openings to eject the label from the impact plate.

9. The label applicator system of claim 8, further including a printing unit and a supply roll for a liner on which a plurality of labels are disposed.

10. The label applicator system of claim 9, further including a rewind roll for accumulating the liner.

11. The label applicator system of claim 8, wherein the air flow generator is an electrically powered fan.

12. The label applicator system of claim 8, wherein the valve system includes a first baffle movably coupled to obstruct the inflow opening in a first state and unobstruct the inflow opening in a second state, and a second baffle movably coupled to obstruct the outflow opening in the second state and unobstruct the outflow opening in the first state, and wherein in the first state the air flow is directed to draw air into the one or more openings in the impact plate and in the second state the air flow is directed to blow air out of the one or more openings of the impact plate.

13. The label applicator system of claim 12, wherein the tamp pad further includes an actuating element coupled to a first arm, a second arm coupled to the first baffle and actuated to move the first baffle between the first and second positions, a third arm coupled to the second baffle and actuated to move the second baffle between the first and second positions, wherein the first arm is coupled to the second arm by a linkage.

14. The label applicator system of claim 8, wherein the tamp pad further includes a structure for coupling the tamp pad to the actuator.

15. The label applicator system of claim 14, wherein the structure includes one or more counter-bored holes defined through the housing of the tamp pad for one or more fasteners to secure the tamp pad to the moveable tamp pad actuator.

* * * * *